United States Patent [19]

Hampson

[11] 4,354,685

[45] Oct. 19, 1982

[54] HAND TOSS-CATCH GAME APPARATUS

[76] Inventor: Edward A. Hampson, 4704 Harlan St., Ste. 260, Denver, Colo. 80212

[21] Appl. No.: 277,282

[22] Filed: Jun. 25, 1981

[51] Int. Cl.[3] ..... A63B 71/04

[52] U.S. Cl. ..... 273/342

[58] Field of Search ..... 273/342, 30, 29 R, 29 A

[56] References Cited

U.S. PATENT DOCUMENTS

| | | | |
|---|---|---|---|
| 2,051,476 | 8/1936 | Grant | 273/342 |
| 2,275,179 | 3/1942 | Heil | 273/342 X |
| 2,931,650 | 4/1960 | Fihe | 273/30 |
| 3,372,934 | 3/1968 | Heil | 273/342 |
| 3,697,068 | 10/1972 | McDougall | 273/29 A |
| 3,968,967 | 7/1976 | Nally | 273/342 |
| 4,045,022 | 8/1977 | Grant et al. | 273/29 R |
| 4,146,225 | 3/1979 | Hallett et al. | 273/342 |

*Primary Examiner*—William H. Grieb

*Attorney, Agent, or Firm*—Ancel W. Lewis, Jr.

[57] ABSTRACT

Game apparatus includes a fold-up board (12) including a lateral bar (28) dividing the board into opposite playing areas on opposite sides. A longitudinal center strip (17) divides the playing area into two parts on each side. These playing parts have contrasting colors on each side which match diagonally with the same colors on the other side. The top playing surface has a layer of granules (21) distributed substantially uniformly throughout to provide spin enhancement of playing balls (31) that are thrown by the hand over and around the ends of the bar and onto the playing areas. The balls have a high degree of resiliency and are matched with the size of the board to provide a highly competitive game.

11 Claims, 5 Drawing Figures

HAND TOSS-CATCH GAME APPARATUS

TECHNICAL FIELD

This invention relates generally to devices used for game purposes, and more particularly to a novel game apparatus.

BACKGROUND ART

A number of devices in the game, toy or amusement category have been provided heretofore. Board or table-type games such as table tennis require a considerable space for use, are relatively expensive, and use paddles or similar devices to propel the ball.

DISCLOSURE OF INVENTION

In accordance with the present invention the game apparatus includes a relatively compact board that is small as compared to the size of the playing surface used for table tennis, folds up into a relatively small area for carriage and storage, and does not require a net. This game apparatus includes solid balls that have a high degree of resiliency and which are tossed and caught using one or both hands in the play rather than propelled by a paddle or the like. The surface of the board has a layer of granules spread thereon for ball spin enhancement. The game requires considerable hand-eye coordination and affords a high degree of competition between two or four players.

BRIEF DESCRIPTION OF DRAWINGS

The details of this invention will be described in connection with the accompanying drawings, in which.

DETAILED DESCRIPTION

Figure 1:
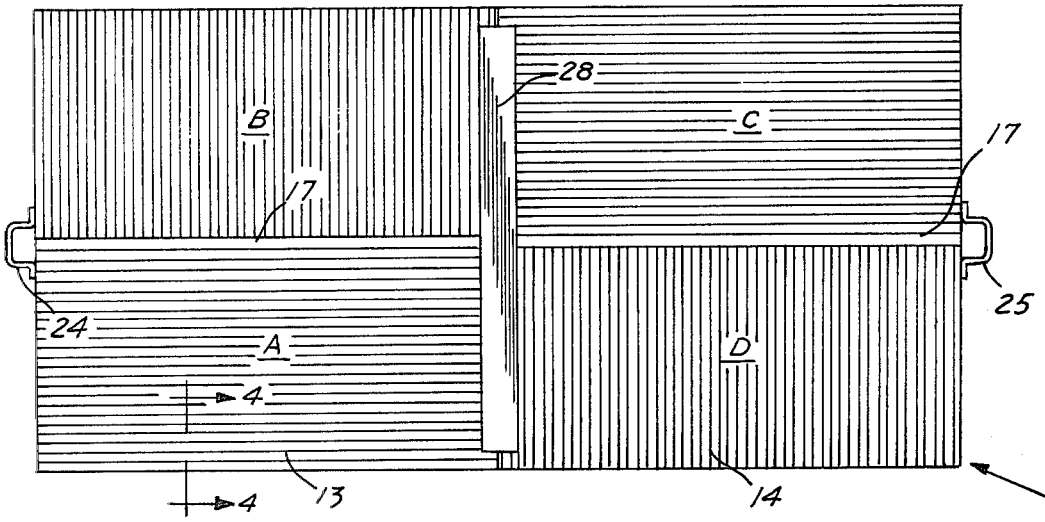
FIG. 1 is a top plan view of the game apparatus embodying features of the present invention.
Figure 2:
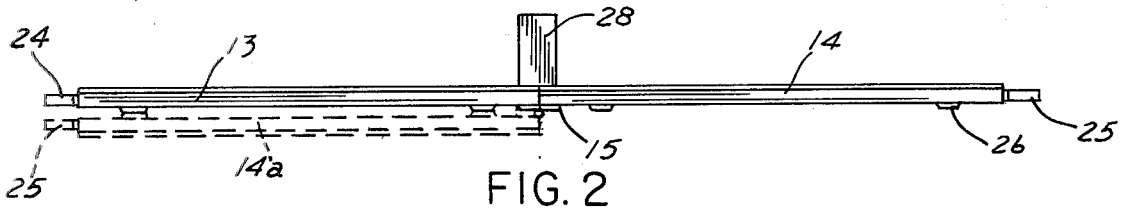
FIG. 2 is a side elevation view of the apparatus of FIG. 1 with dashed lines showing the board in the folded position.
Figure 3:
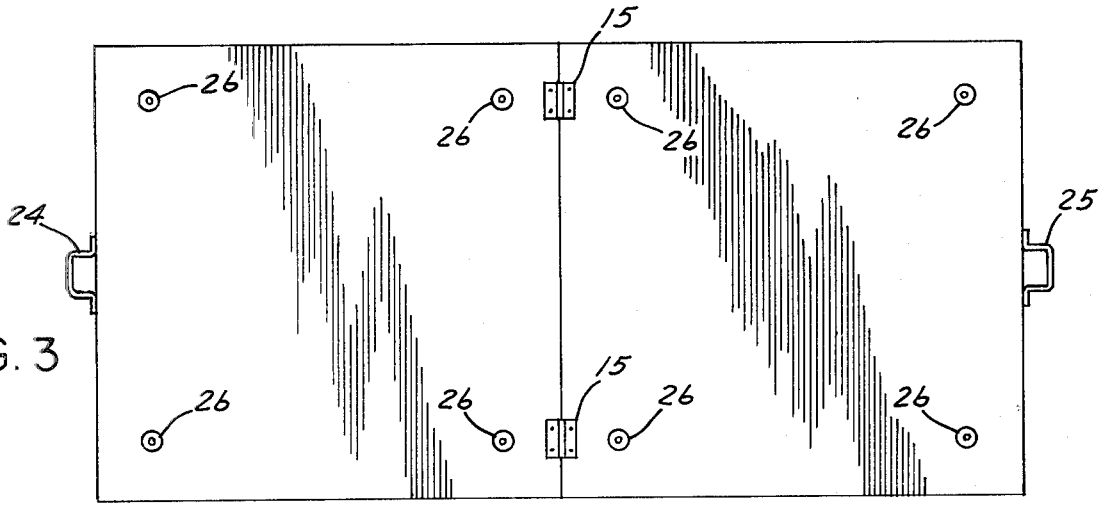
FIG. 3 is a bottom plan view of the board shown in FIG. 1.
Figure 4:
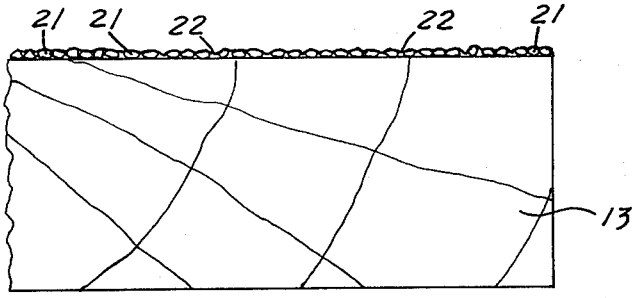
FIG. 4 is a sectional view taken along lines 4—4 of FIG. 1.

Referring now to the drawings, in FIG. 1 there is shown a hand toss-catch game apparatus which includes a fold-up playing table or board 12 having two half-sections 13 and 14, each of a square configuration, that are hingedly joined by a pair of laterally spaced hinges 15 to be movable between a playing position shown and a folded position with the sections side by side as indicated in dashed lines 14*a*. In the folded position the half-sections are side by side. A preferred material for the board 12 is plywood.

A removable lateral bar 28 of a selected height and width divides the board into opposite playing areas on opposite sides. The bar is of less length than the width of the board or does not go all the way to the side edges of the board, to allow for tossing the ball over the corners of the side sections past the outside ends of the lateral bar. A preferred material for the bar is solid wood.

The board has a longitudinal center strip 17 dividing the playing area on each side into two parts designated A and B on one side and two similar parts C and D on the other side. These parts preferably have contrasting colors on one side which match diagonally with the same colors on the other side. Examples of contrasting colors for the playing parts on which side are yellow and blue, green and white, red and white, and green and yellow.

The top playing surface has a layer of granules or pellets 21 substantially uniformly distributed throughout the entire top playing surface. The granules are preferably secured as by a binder or adhesive coating 22, which provide a textured top playing surface and provide spin enhancement of the playing balls. In a preferred practice, the granules are relatively fine sand that is mixed with the paint and then painted on the entire top surface of the board.

Pads 26 are provided at the corners of each half-section of the board on the under surface thereof. A handle 24 is shown connected to the end of section 13 and a handle 25 connected to the end of section 14 to facilitate carrying the board when in the folded position.

Figure 5:
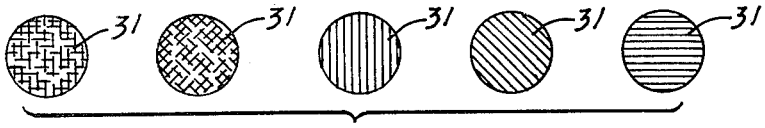
FIG. 5 is a side elevation view of playing balls which are used, in combination with the board shown in FIG. 1, during the play of the game.

Balls of contrasting colors are used by each player, which are each designated by the numeral 31 and illustrated in FIG. 5 and are used by the player as described hereinafter. During play it is advantageous to put as much spin as possible on the ball in tossing it first on the one side, over or around the bar, and then on the other side. These balls preferably are of a solid rubber construction having a high degree of resiliency such as an 85% bounce recovery and are commonly sold under the name "Super Balls." The balls are matched with the size of the board to provide a highly competitive game.

By way of illustration but not limitation, the dimensions for the above described apparatus are:

| | |
|---|---|
| Board length | 48 inches |
| Board width | 24 inches |
| Bar length | 22 inches |
| Bar height | 4 inches |
| Bar width | 2 inches |
| Ball diameter | 1 inch |

RULES

The preferred rules governing the play of the above described game apparatus are as follows:

On every shot the ball must bounce once on the serving player's side and once on the receiving player's side.

The bar 28 is considered a part of the playing board on all points except the serve, and a shot which bounces once on the shooting player's side and hits the bar must bounce once on the receiving player's side to be in play.

On all serves and points the ball may be sent with one or both hands only. On instrument, paddle or other device may be used for sending or receiving any shot.

The ball must be caught by the receiving player cleanly with one or both hands before it has bounced twice on the receiver's side or struck any object except the playing surface.

The ball may not strike or be trapped against any part of the body of the player except the hands or forearms.

The ball must be allowed to bounce on the receiving player's side before being caught.

On the first point of a serving game the point is odd, the second even, and so on throughout the game.

The center line 17 is considered to be a part of both areas of the receiver's side.

There is no restriction on which side of the receiver's playing area the first serve of a game must bounce.

After the first serve of a game and throughout that service game until the score shall have reached 4 to 4, the serve must alternate as to the playing area of the receiver's side on which it bounces.

After the first serve of a game, the server must announce aloud the playing area, preferably by color, on which all odd serves throughout that service game must be played, in terms such as "odds are blue" or "odds are yellow."

Any serve which strikes any part of the center line is in play.

If a serve bounces on the server's side, hits the bar and then bounces on any part of the receiver's side, the serve must be replayed. In all other cases the server has only one opportunity to put a serve in play.

The game may be played by two or four players at a time.

SCORING

A match shall consist of one or more sets which shall in turn consist of at least 5 games if one player is ahead by at least 2 games.

A game shall consist of at least 5 points, and the first player to score 5 points wins the game.

The server shall serve one entire game until the set score shall have reached 5 games apiece.

Serve rotates between games.

If the game score shall reach 4 points each, the receiver shall have the choice of which side of his playing area on which he wishes to receive the serve.

If the score of the set shall reach 5 games apiece, one "final game" decides the set.

The final game shall again consist of at least 5 points, with the serve throughout the game altnernating in normal rotation between the players.

In the final game there shall be no restriction on that half of the receiver's playing area on which the serve must bounce unless the "final game" score reaches 4 to 4, in which event the receiver has the choice of the receiving side of his playing area.

The first server of each first game may be determined by the flip of a coin.

At the end of each set the players shall switch ends of the board, and the loser of the previous set shall start serving the next set.

Although the present invention has been described with a certain degree of particularity, it is understood that the present disclosure has been made by way of example and that changes in details of structure may be made without departing from the spirit thereof.

What is claimed is:

1. Game apparatus comprising:

a playing board including two half-sections joined to move between playing position and a folded position, said board having a top playing surface provided with a layer of granules secured thereto throughout the playing surface for spin enhancement of a playing ball that is bounced on said surface by a player on each side of the board;

a lateral bar of a selected width and height separating the playing board into playing areas on opposite sides; and a longitudinal strip dividing the playing areas on each side into two playing parts of equal size, the playing ball being hand-tossed by a player to bounce first on one side playing area and then on the other side playing area over said bar during play of the game.

2. Game apparatus as set forth in claim 1 wherein said playing parts have contrasting colors on each side which match diagonally with the same colors of playing parts on the opposite side.

3. Game apparatus as set forth in claim 1 wherein said board has handles on opposite ends for carrying the board when in the folded position.

4. Game apparatus as set forth in claim 1 wherein said board sections have support and furniture protective pads at the corners along the bottom surface thereof.

5. Game apparatus as set forth in claim 1 wherein each half-section is in the configuration of a square.

6. Game apparatus as set forth in claim 5 wherein each half-section is of a size about 24 inches by 24 inches.

7. Game apparatus as set forth in claim 1 wherein said granules are a relatively fine sand mixed into the paint before coating the playing surface.

8. Game apparatus as set forth in claim 1 wherein said playing board is made of plywood and said bar of a solid wood.

9. Game apparatus as set forth in claim 1 wherein said bar is a part separate from said board and rests on the top surface when said sections are in a coplanar playing position.

10. Hand-toss catch game apparatus comprising:

a playing board including two half-sections hingedly joined at adjacent ends to move between a playing position wherein said sections are arranged coplanar and a folded position wherein said sections overlap one another, said board having a top playing surface coated with a layer comprised of a mixture of sand and paint to provide a textured playing surface for the spin ehancement of a playing ball that is bounced on said playing surface by at least one player on each side of the board, using the hand to toss the ball, said ball having a high degree of resiliency;

a removable lateral bar of a selected width and height centered on said board and separating the playing board into opposed playing areas on opposite sides of the board, said bar being shorter than the width of the board; and a longitudinal line dividing the playing areas on each side into two equal parts, the playing ball being hand-tossed by a player to bounce first on one side playing area and then on the other side playing area and then over the bar or around the ends of the bar during the play of the game.

11. Hand toss-catch game apparatus as set forth in claim 10 wherein said board has a width of about 24 inches, a length of about 48 inches, and said bar has a height of about 4 inches, a length of about 22 inches, and a width of about 2 inches.

* * * * *